US006966332B2

(12) United States Patent
Wigzell

(10) Patent No.: US 6,966,332 B2
(45) Date of Patent: Nov. 22, 2005

(54) AIR VALVE ASSEMBLY FOR A FIRE HYDRANT

(76) Inventor: Michael David Wigzell, 62 Moore Avenue South, Waterloo, Ontario (CA) N2J 1W9

( * ) Notice: Subject to any disclaimer, the term of this patent is extended or adjusted under 35 U.S.C. 154(b) by 0 days.

(21) Appl. No.: 10/948,123

(22) Filed: Sep. 24, 2004

(65) Prior Publication Data

US 2005/0067016 A1 Mar. 31, 2005

Related U.S. Application Data

(60) Provisional application No. 60/505,750, filed on Sep. 26, 2003.

(51) Int. Cl.[7] ..... E03B 9/14
(52) U.S. Cl. ..... 137/302; 137/307; 137/107
(58) Field of Search ..... 137/1, 15.02, 202, 137/282, 283, 301, 302, 307, 308, 433, 528, 137/538, 315.01, 107

(56) References Cited

U.S. PATENT DOCUMENTS 352,288 A * 11/1886 Bardo et al. ..... 137/307
490,601 A * 1/1893 Richards ..... 137/307
607,413 A * 7/1898 Mathews ..... 137/307
1,134,882 A * 4/1915 Lowe ..... 137/202
1,340,352 A * 5/1920 Whitmore ..... 137/283
1,349,062 A * 8/1920 Goldberg ..... 137/283
1,828,763 A * 10/1931 Carnes ..... 137/302
2,485,437 A * 10/1949 Dwyer ..... 137/202
2,630,823 A * 3/1953 Mueller ..... 137/283
2,633,143 A * 3/1953 Simon ..... 137/298
2,646,817 A * 7/1953 Cox et al. ..... 137/202
2,664,096 A * 12/1953 Murdock et al. ..... 137/301
2,853,092 A * 9/1958 Klikunas ..... 137/202
3,980,097 A * 9/1976 Ellis ..... 137/283
4,854,339 A * 8/1989 Hoeptner, III ..... 137/282
5,033,500 A * 7/1991 Hoeptner, III ..... 137/282

* cited by examiner

*Primary Examiner*—Kevin Lee
(74) *Attorney, Agent, or Firm*—Daryl W. Schnurr

(57) ABSTRACT

An air valve assembly for a fire hydrant includes a pressure responsive valve means removably mounted at or near a top of a fire hydrant and more specifically to a fire hydrant bearing housing. The pressure responsive valve means is adapted to open when the fire hydrant is not in use and to close when the fire hydrant is in use.

14 Claims, 6 Drawing Sheets

AIR VALVE ASSEMBLY FOR A FIRE HYDRANT

Priority is claimed based upon U.S. provisional application Ser. No. 60/505,750 Filed on Sep. 26, 2003.

BACKGROUND OF THE INVENTION

1. Field of the Invention

This invention relates to drainage of fire hydrants and, more particularly, to an air valve assembly for use in a fire hydrant where the air valve assembly operates in cooperation with conventional drain valves to automatically drain excess water from the fire hydrant after the cap has been placed on the nozzle of the fire hydrant. This invention further relates to an air valve assembly and hydrant in combination and to a method of constructing a hydrant to drain automatically.

2. Description of the Prior Art

Fire hydrants should be drained after they are used to remove any excess water that is sitting in the barrel of the fire hydrant. As this task takes time, it is often overlooked by the user and the cap is replaced on the nozzle of the fire hydrant resulting in an air-tight seal so that any remaining water stays prematurely within the fire hydrant. As a result, any water left in the barrel stagnates resulting in possible contamination to the potable water supply. Remaining water can also result in damage to the hydrant if the water freezes thereby cracking the barrel and/or damaging other components. Municipalities incur significant costs to repair and maintain their fire hydrant systems.

Ellis is the owner of U.S. Pat. No. 3,980,097, which issued on Sep. 14, 1976. This patent relates to a fire hydrant of the "dry" barrel type having an improved means of draining the barrel after the hydrant has been used and the main hydrant valve closed. The hydrant is provided with a drain passageway from the interior of the barrel above the main hydrant valve to the exterior of the valve. A first valve means, which is automatically opened or closed by actuation of the main hydrant valve element, is arranged to close the drain passageway when the main hydrant valve element is open and to open the drain passageway when the main hydrant valve element is closed. A pressure responsive one-way check valve in series with the valve means in said drain passage is automatically actuated to open position by pressure of water when there is water in the hydrant barrel and the valve means in series therewith in the drain passageway is open. The one-way check valve automatically closes when the barrel is dry and prevents ingress of water and dirt, grit or other foreign matter from the exterior of each to the interior, thereby protecting the main hydrant valve and its associated operating mechanism.

Previous hydrants have drain valves near a base of the barrel that open when the hydrant is shut off to allow the barrel to drain. However, when the airtight caps on the nozzle are replaced before the barrel has drained, the water stops draining as no air can enter the barrel above the level of the water that remains in the barrel. The water remains trapped in the barrel even though the drain valves near the base of the barrel remain open. In cold climates, municipalities often have all hydrants inspected before the onset of freezing temperatures to ensure that the hydrants are properly drained. These inspections are extremely expensive. If a hydrant is not properly drained after use and the water within the hydrant freezes, the hydrant will be inoperable and unavailable for use in fighting a fire.

Thus an air valve assembly for a fire hydrant which allows residual water in the barrel of the fire hydrant to be drained away after the cap has been placed on the nozzle, thereby removing any risk to the potable water supply by draining away any stagnating water, as well as removing any risk of damage to the fire hydrant if water froze within the barrel while at the same time reducing the time a user would have to spend waiting for the water to drain is desirable.

SUMMARY OF THE INVENTION

An object of one aspect of the present invention is to provide an air valve assembly and a system for automatically draining a fire hydrant after use.

An air valve assembly is used in a fire hydrant. The hydrant has a barrel with a main valve located within the barrel operable between a closed position and an open position. The main valve is located at a lower end of the barrel and in the open position allows the hydrant to fill with water and to supply water under pressure from the hydrant. The main valve is closed to shut off the hydrant. There are drain valves located near the main valve that extend through the outer wall of the hydrant. The drain valves are pressure operated and close when the main valve is opened and open when the main valve is closed. The air valve assembly is mounted in a wall of the barrel near a top thereof and has an open position and a closed position. The air valve assembly moves between the open position and the closed position in response to pressure within the barrel. When the main valve is open and the pressure within the barrel increases, the air valve assembly moves to the closed position to prevent water from exiting from the barrel through the air valve assembly. When the hydrant is turned off by moving the main valve to the closed position the air valve assembly moves to the open position to permit ambient air to enter the barrel, thereby forcing the water in the barrel out of the open drain valve.

Preferably, the air valve assembly is located at a top of the barrel. Preferably, the hydrant has a bonnet located on top of the barrel and the air valve assembly is mounted in a wall at the top of the barrel that extends between the bonnet and the barrel.

Still more preferably, the air valve assembly has a piston that moves longitudinally within a bore relative to a seat, the air valve assembly being closed when the piston is seated against the seat and being open when the piston moves away from the seat.

Still more preferably, the piston is located beneath the seat and can move by gravity from the closed position to the open position.

The air valve assembly has a housing containing at least one opening therein to permit air to flow through said opening when said valve is in an open position.

When the fire hydrant has a bonnet, there is preferably a hole located in the bonnet to allow ambient air to pass between the hole and the air valve assembly.

The present invention further relates to a fire hydrant in combination with an air valve assembly and to a method of constructing a fire hydrant to drain automatically when the hydrant is not in use even when the air tight caps are replaced on the nozzles before the hydrant has drained completely.

An air valve assembly and fire hydrant in combination comprises a hydrant having a barrel with a main valve operable between an on position and an off position. The main valve is located at a lower end of said barrel and is open to charge said hydrant and to supply water from said hydrant. The main valve is closed to shut off the hydrant. There are drain valves located near the main valve. The drain valves are pressure operated and close when the main valve is opened and open when the main valve is closed respectively. The air valve assembly is located in a wall of the barrel at or near a top thereof. The air valve assembly has access to ambient air. The air valve assembly has an open position and a closed position. The air valve assembly is constructed to close under pressure when the hydrant is charged with water and the hydrant is on and is constructed to open under pressure when the hydrant is turned off. The air valve assembly permits air to enter the barrel to cause the barrel to drain properly.

Preferably, the barrel has a bonnet on a top thereof and the air valve assembly is mounted in an upper wall of the barrel extending between the barrel and the bonnet. The air valve assembly is mounted to connect an interior of the bonnet with an interior of the barrel.

Still more preferably, the bonnet has a hole therein to connect an interior of the bonnet with ambient air.

A method of constructing a fire hydrant having a barrel with a main valve, the main valve being connected to turn the water supply on in an open position and to turn the water supply off in a closed position, there being drain valves around a base of the barrel that open under pressure when the main valve is turned off, the drain valves being closed off when the main valve is open, said method comprising installing an air valve assembly near a top of the barrel to connect an interior of the barrel with ambient air, constructing said air valve assembly to close under pressure from the water when the main valve is turned on and to open to allow ambient air to enter the interior of the barrel when the main valve is turned off, the ambient air causing the water within the barrel to substantially drain from the drain valves when the main valve is turned off.

In accordance with one aspect of the present invention there is provided an air valve assembly for a fire hydrant that includes a pressure responsive valve means removably mounted to the fire hydrant and more specifically to the fire hydrant bearing housing. The pressure responsive valve means may be adapted to open when the fire hydrant is not in use and closed when the fire hydrant is in use.

Conveniently, the pressure responsive valve means may be further defined as including a valve body having an inlet for air, a sealing ring, a stopping member and a movable element.

Preferably, the valve body may be installed into the bearing housing of the fire hydrant. The air valve assembly may be mounted to the fire hydrant by tapping through the bearing housing and installing the drain valve assembly with one end within the barrel of the fire hydrant and the other end exposed but under the fire hydrant's bonnet. An air inlet hole may be drilled into the bonnet to allow air under the bonnet and therefore into the inlet.

An air valve assembly for a fire hydrant, the hydrant having a bonnet at a top thereof, comprises a pressure responsive valve mounted in a housing at a top of the hydrant between the bonnet and an interior of the hydrant. The assembly has a closed position and an open position. In an open position, the assembly provides a passage between the ambient air and the interior of the hydrant. The hydrant has a main valve and a drain valve, the assembly being constructed to move to the closed position when the hydrant is on and to move to the open position when the hydrant is off.

Advantages of the present invention are: the cap may be immediately replaced on the nozzle of the fire hydrant and the user may immediately leave while the remaining water within the fire hydrant barrel automatically drains using the drain valve assembly; there is no need to pump out the fire hydrant thereby wasting valuable time while the user waits for this process to be completed; once the water has drained away, the fire hydrant is now left in a state of readiness without having to worry about residual water freezing and causing damage to the fire hydrant, as well as any residual water stagnating and possibly contaminating the local water supply; and the positioning of the drain valve assembly under the bonnet thereby prevents any material from entering the first open end of the valve body that could cause any malfunction or contamination.

BRIEF DESCRIPTION OF THE DRAWINGS

A detailed description of the preferred embodiment is provided herein below by way of example only and with reference to the following drawings, in which.

Figure 1:
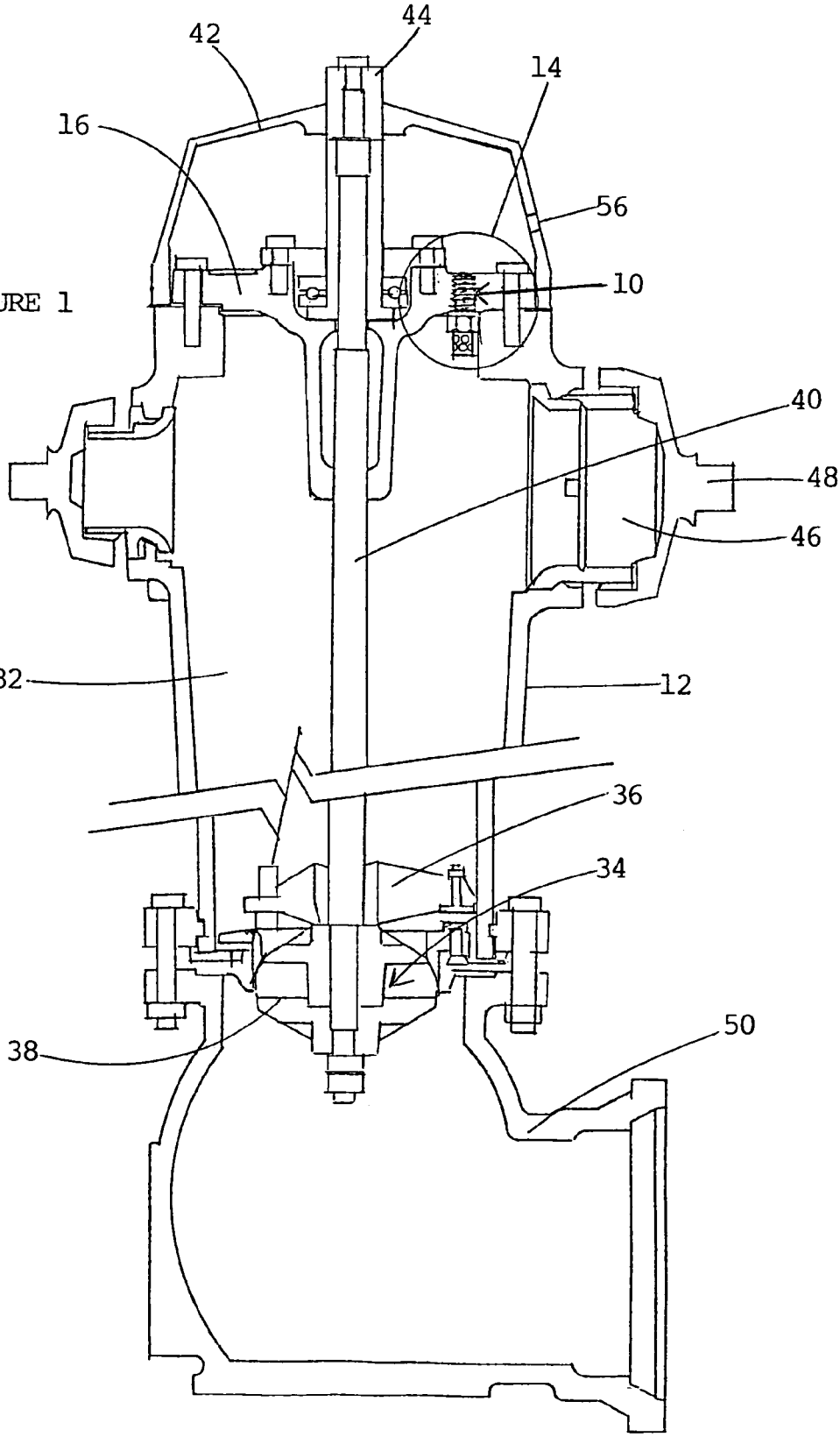
FIG. 1 is a schematic cross-sectional view illustrating an air valve assembly with a fire hydrant in an off position.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF A PREFERRED EMBODIMENT

Figure 2:
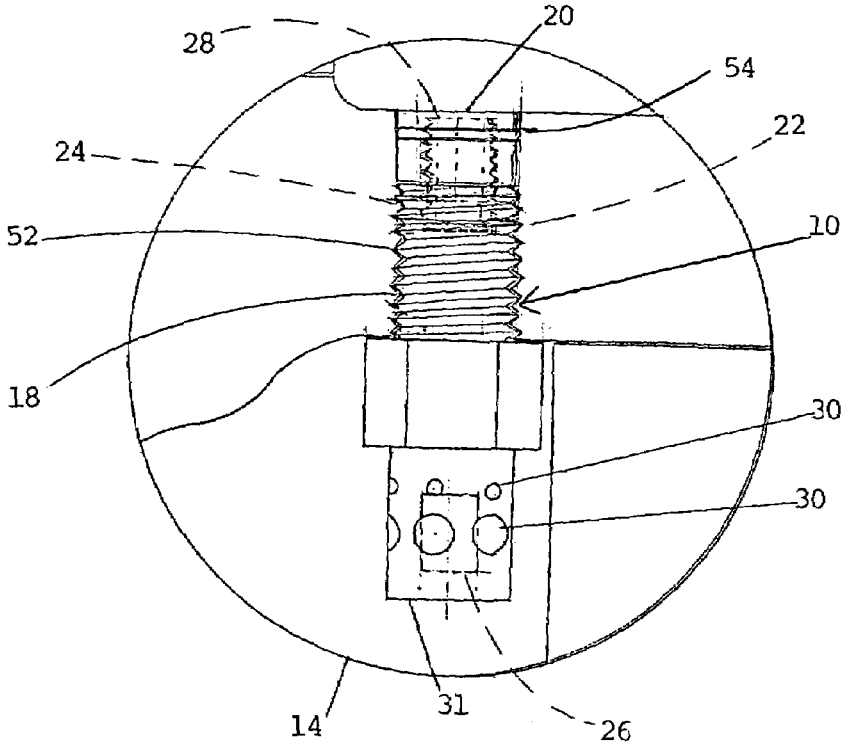
FIG. 2 is an enlarged schematic cross-sectional view of the air valve assembly portion of FIG. 1.

Referring to FIGS. 1 and 2, there is illustrated in cross-sectional views, an air valve assembly 10 mounted in a fire hydrant 12 in accordance with the preferred embodiment of the present invention. The air valve assembly 10 for a fire hydrant 12 includes a pressure responsive valve. The assembly 10 is removably mounted to the fire hydrant 12 and more specifically to a fire hydrant bearing wall 16. The pressure responsive valve is adapted automatically to open when the fire hydrant 12 is off and to close when the fire hydrant 12 is on. When the fire hydrant is not in use, it is considered to be off and when the fire hydrant is in use, it is considered to be on. The air valve assembly 10 is surrounded by a circle 14 in FIG. 1. FIG. 2 is an enlarged view of the circle 14.

The pressure responsive valve may be further defined as including a valve body 18 having an air inlet 20, a sealing ring 22, a seat 24 and a piston 26. More specifically, the valve body 18 has a bore 28 with said air inlet 20 at an outer end and a plurality of openings 30 at an inner end 31. The air inlet 20 allows for air to enter the valve body 18. The openings 30 allow any water to leave the valve body 18 as well as allowing for air coming through the inlet 20 to enter the hydrant 12 through the bore 28 of the valve body 18. More specifically, the air flows into a barrel 32 of the fire hydrant 12. Any water accumulated in the valve body 18 while the hydrant 12 is in use may exit the valve body 18 through the plurality of openings 30. The hydrant 12 has a main valve 34 that is closed when the hydrant 12 is in the off position. The hydrant 12 has a main valve assembly 34 and a drain valve assembly 36. The main valve assembly 34 has a main valve 38 that is mounted oil a shaft 40.

At a top of the barrel 32, above the bearing wall 16, there is located a bonnet 42. The shaft 40 has a nut 44 at a top thereof and nozzles 46 have caps 48. Except for the air valve assembly 10, the hydrant 12 is conventional. While only one design of a hydrant is shown, the air valve assembly can be used with hydrants of other designs as well. The hydrant 12 is connected to a water supply line 50, which supplies water under pressure (not shown) to the barrel 32 and, as desired, through the nozzles 46 to hoses or other accessories (not shown), as desired by a user. In the off position shown in FIGS. 1 and 2, when the main valve assembly 34 is closed, the drain valve assembly 36, which is controlled by pressure within the barrel 32, opens. Similarly, the air valve assembly 10 moves to the open position as water drains through the drain valves of the drain valve assembly 36 and the pressure within the barrel decreases.

The seat 24 may be further defined as a tapered hex plug that is located near the air inlet 20 of the valve body 18. The plug has a centre channel to allow air to flow through the bore. The sealing ring 22 may be defined as an "O" ring located adjacent the tapered hex plug 24. The piston 26 may be any movable element adapted to move within the valve body 18 between an open position and a closed position. The piston preferably has a concave lower surface 27 (not shown in FIGS. 1 and 2) to improve the upward movement of the piston. In FIGS. 1 and 2, the air valve is in an open position.

Figure 3:
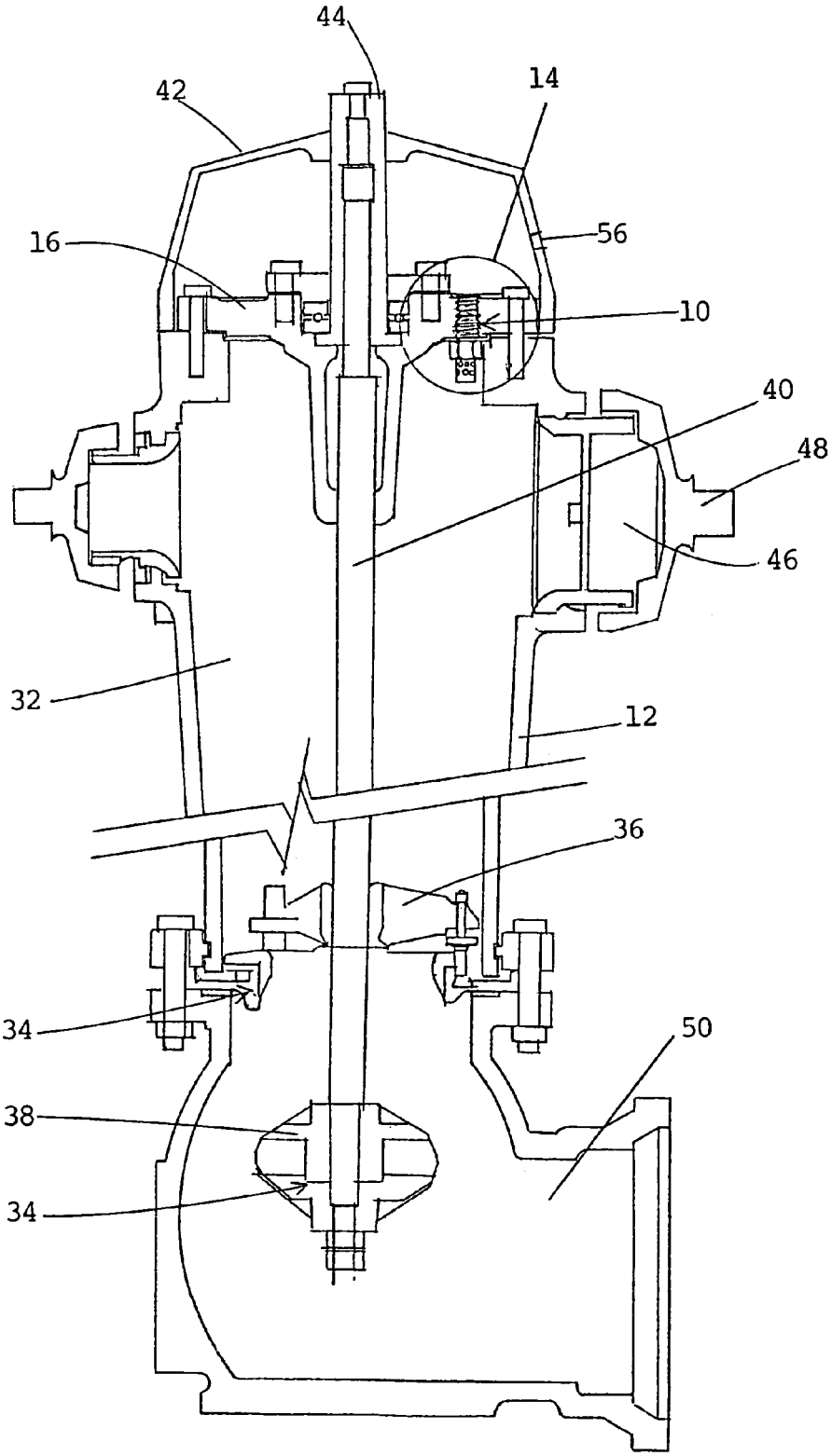
FIG. 3 is a schematic cross-sectional view illustrating the air valve assembly with the fire hydrant in an on position.

As shown in FIGS. 1 and 2, when the fire hydrant 12 is on or in the charged position and the pressure is sufficiently high, the piston 26 will move within the valve body 18 to contact the "O" ring 22 and seat 24, thereby blocking the inlet 20. The air valve assembly 10 is in the closed position. Water (not shown) flows into the barrel 32 of the hydrant 12 when the main valve is open. In the closed position, air cannot enter the valve body 18 and water cannot exit. Specifically, the piston 26 moves through the bore 28 within the valve body 18 from the open position shown in FIGS. 1 and 2 to the closed position shown in FIGS. 3 and 4 as a result of high pressure air or water from the barrel 32 entering the valve body 18.

Figure 4:
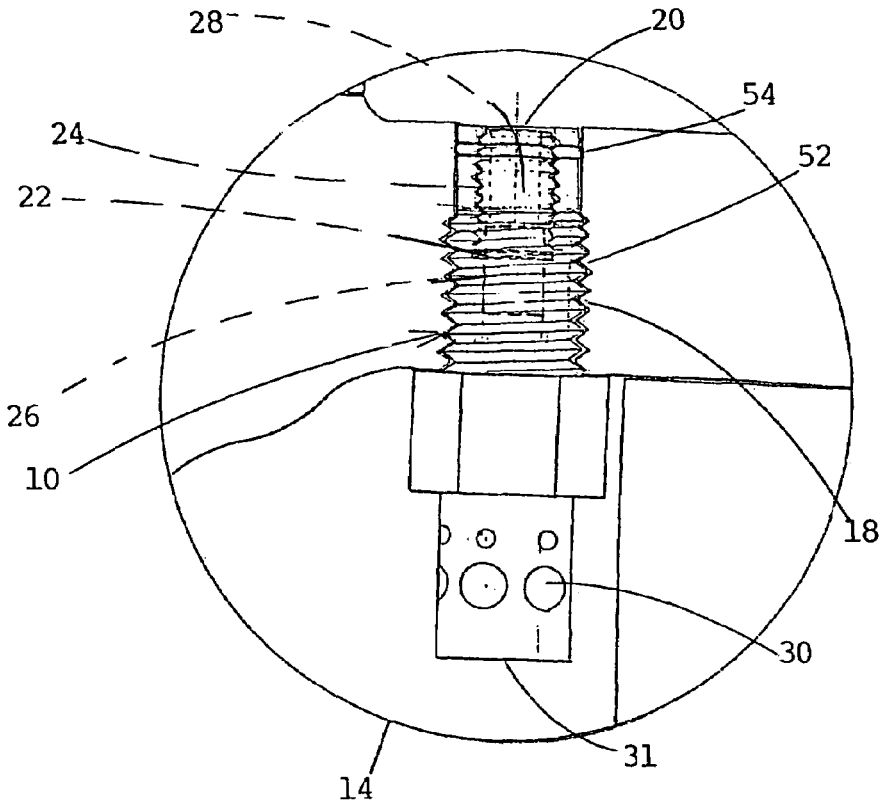
FIG. 4 is an enlarged schematic cross-sectional view of the air valve assembly portion of FIG. 3.

The piston 26 moves from the inner end 31 shown in FIG. 2 to the outer end shown in FIG. 4 where the piston 26 is forced against the seat 24 and is in contact with the seal 22. In the closed position shown in FIG. 4, the bore 28 is closed. The pressure from the water or the air within the barrel or from the water itself forces the piston 26 to move and contact the "O" ring 22 which becomes sandwiched between the tapered hex plug 24 and the piston 26, thereby creating a seal so as to not allow air in or water to pass through the valve body 18. Preferably both the plug and a tap (not shown) into which the plug is inserted have tapered threads. The same reference numerals are used in FIGS. 3 and 4 as those used in FIGS. 1 and 2 to describe those components that are identical. FIG. 4 is an enlarged view of those components located in the circle 14 shown in FIG. 3.

When the fire hydrant 12 is off or is uncharged (i.e. achieved by closing the main valve 34), water will exit the barrel 32 of the fire hydrant 12 through the drain valves 36 located at the base of the barrel 32, thereby relieving pressure on the piston 26 and causing the piston 26 to move away from the seal or "O" ring 22 and the seat 24 to the open position. The piston 26 will therefore move to the inner end 31 of the valve body 18 where it will rest within the valve body 18. Once the seal is broken between the piston and the "O" ring, ambient air will enter the valve body 18 through the inlet 20, down the bore 28 and out the openings 30, thereby allowing air into the barrel 32 of the fire hydrant 12 and therefore causing pressure on top of any water in the barrel to force the water from the barrel. The fire hydrant 12 will continue to draw air through the inlet 20 therefore causing any remaining water in the barrel 32 of the fire hydrant 12 to drain out of the barrel 32 through the drain valve(s) 36 into the gravel bed (not shown) until the barrel 32 in completely empty. When the main valve 38 is initially opened, the air in the barrel 32 will be forced out of the barrel through the still open air valve assembly 10. As the air becomes more compressed, the air pressure (caused by the incoming water) will cause the air valve assembly 10 to move to the closed position. Any air remaining in the barrel will likely be exhausted when the nozzle 46 is opened. If a small amount of air remains in the barrel during operation, it will not reduce the water supply capability of the hydrant.

The valve body 18 is preferably installed into the bearing wall 16 of the fire hydrant 12. Typically, a fire hydrant 12 includes the barrel 32 having the bearing wall 16 located at the top of the barrel 32 and the bonnet 42 covering the bearing wall 16. The air valve assembly 10 may be mounted in the fire hydrant 12 by tapping through the bearing wall 16 and installing the air valve assembly 10 with the inner end 31 of the valve body 18 located within the barrel 32 of the fire hydrant 12 and the air inlet 20 having access to ambient air, but being under the bonnet 36 and outside the bearing wall 16 The valve body 18 has an external screw thread 52 thereon and a seal 54. The valve body 18 is preferably threaded so as to allow installation into the bearing wall 16. Still more preferably, there is a pipe thread on both the valve body and in the bearing wall and the seal 54 is eliminated. An air inlet hole 56 is preferably drilled into the bonnet 42 to allow ambient air to enter the bonnet 42 and therefore to pass into the inlet 20. Preferably, the hole 56 is located in a side wall of the bonnet 42. The hole 38 is preferably plugged with a rubber grommet (not shown) having a longitudinal central opening (not shown) with a screen (not shown) located therein. The grommet and side wall location substantially prevent rain water from entering the bonnet, the screen keeps insects out of the bonnet.

The air valve assembly 10 automatically opens and closes due to pressure changes within the barrel. Since the barrel will drain completely and much more quickly (than hydrants not having an air valve assembly), a cap 48 may be immediately replaced on the nozzle 46 of the fire hydrant 12 and the user may immediately leave the area while the remaining water within the fire hydrant barrel 32 drains using the air valve assembly 10. There is no need to pump out the fire hydrant 12, thereby wasting valuable time, while the user waits for this process to be completed. Furthermore, once the water has drained away, the fire hydrant 12 is now left in a state of readiness. A user would have no concern about residual water freezing and causing damage to the fire hydrant 12, or any residual water stagnating and possibly contaminating the local water supply. There is also no need to inspect the hydrant to determine whether it has drained properly. Finally, the positioning of the air valve assembly 10 under the bonnet 36 prevents foreign material from entering the air inlet 20 of the valve body 18 that could cause any malfunction or contamination.

Figure 5:
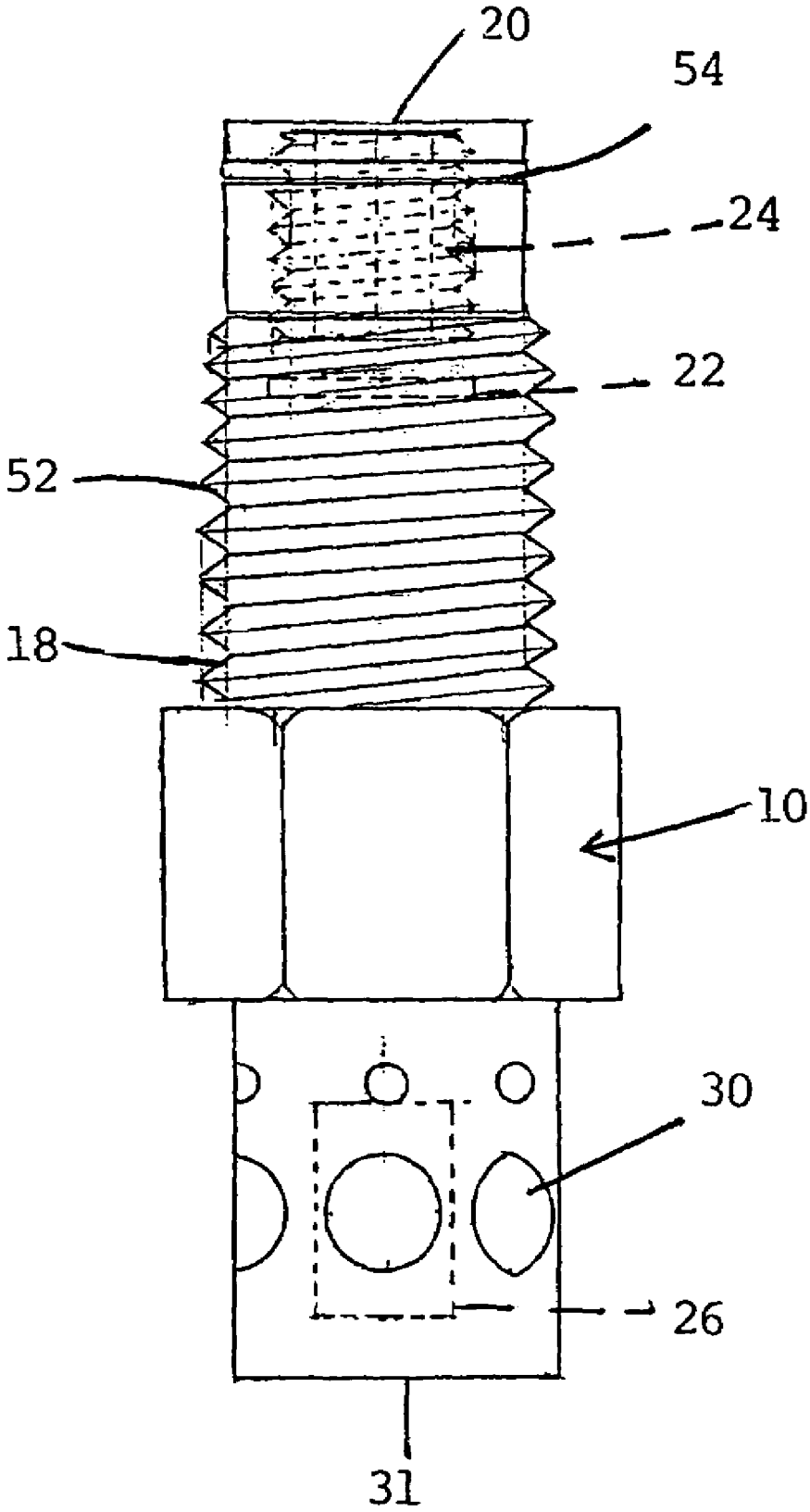
FIG. 5 is a side view of the air valve assembly with part of an interior of the assembly shown by dotted lines.
Figure 6:
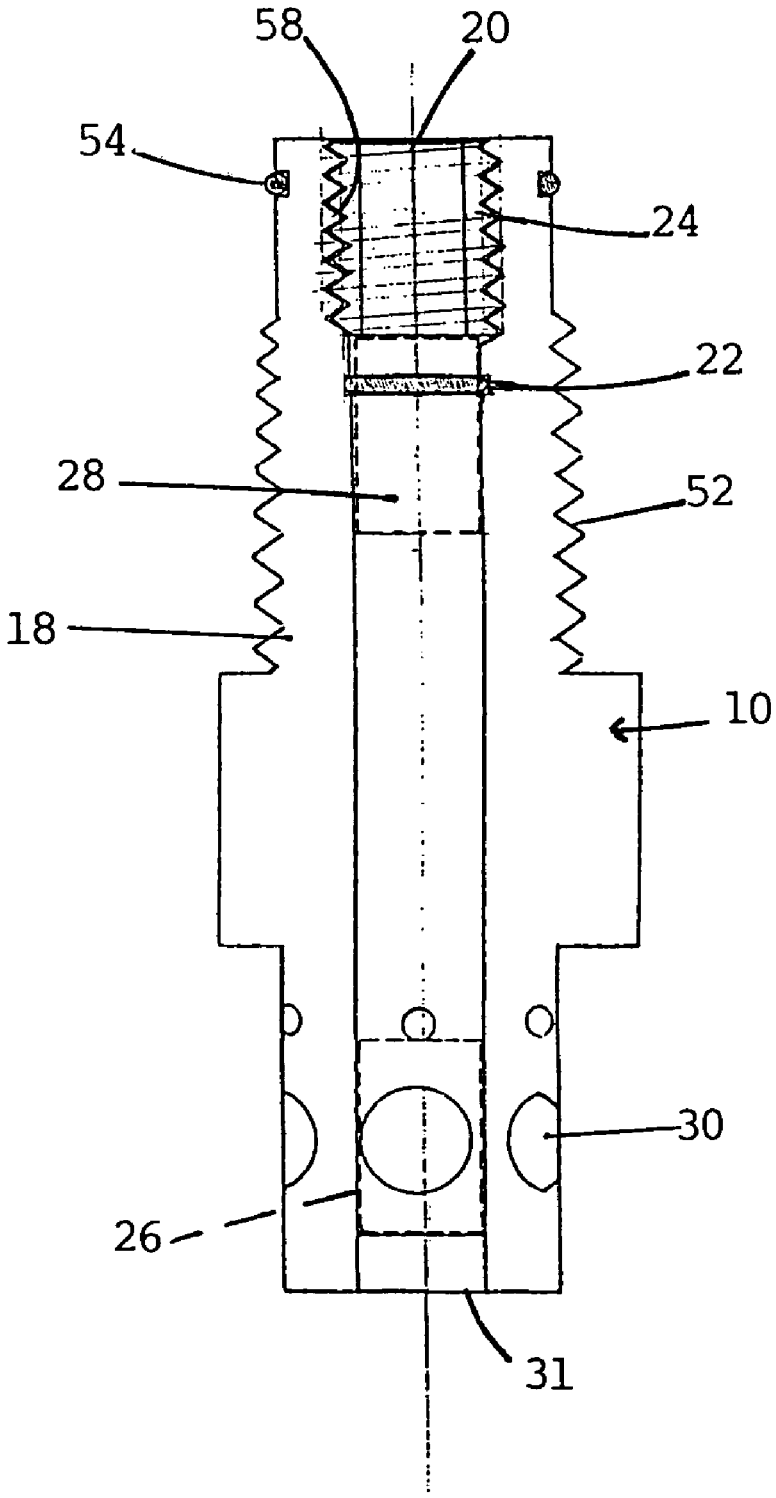
FIG. 6 is a schematic sectional side view of the air valve assembly with a piston shown by dotted lines.

In FIGS. 5 and 6, the same reference numerals are used as those used in FIGS. 2 and 4 to describe those components that are identical. In FIG. 5, there is shown a side view of the air valve assembly 10. By dotted lines, the piston 26 is shown to be located at the inner end 31 and therefore the assembly 10 is in the open position. In FIG. 6, the bore 28 of the air valve assembly is shown schematically. At the outer end, there is a screw thread 58 which allows the seat 24 to be located within the bore 28. It can be seen that the seat 24 has a centrally located channel therein that narrows the bore 28 so that the piston 26 will abut against an inner end of the seat 24. The bore 28 at the inner end 31 is closed off so that the piston 26 will stop when it reaches the area of the openings 30. There are two pistons 26 shown by dotted lines in FIG. 6, one at each end of the bore 28. The two pistons are shown to indicate the two extremes of movement of the piston 26. In reality, of course, there is only one piston 26 within the bore 28. The piston can easily be removed from the bore and replaced by unscrewing the seat 24. It can be seen that the bore has a small circular notch formed therein to receive the seal or "O" ring 22. When the main valve of the hydrant is turned to the on position, water will flow into the barrel and initially, the water will increase the air pressure of the air within the water and air will be exhausted through the openings 30 and the bore 28 to the ambient air. As water continues to flow into the barrel, the air pressure will continue to increase and the air will either be fully exhausted and water will cause the air valve to close or the air pressure will increase to such a level that the piston will move upward within the bore 28 and seat against the seat 24 in contact with the seal 22, thus closing the air valve assembly. The air valve assembly can either be closed by air within the barrel achieving a high enough pressure or by water filling the barrel. When the main valve is turned to the off position and the air tight caps are replaced on the nozzles, the pressure within the barrel will be substantially reduced and some of the water will flow out of the barrel through the drain valves. As the pressure reduces, the piston will become unseated from the seat 24 and will slide down the bore 28 and rest at lower end 31. As the piston becomes unseated, ambient air will enter the bore and ultimately flow into the barrel through the openings 30, thus lowering the pressure within the barrel to atmospheric pressure. The atmospheric pressure will cause the barrel to drain properly until virtually all the water has drained therefrom.

Other variations and modifications of the invention are possible. All such modifications or variations are believed to be within the sphere and scope of the invention as set out herein.

I claim:

1. An air valve assembly for use with a fire hydrant, said assembly having a housing with an air valve located therein, said fire hydrant having a barrel with a main valve located at a lower end of said barrel, said barrel being connected to a water supply, said main valve being operable to control flow of water under pressure to substantially fill and replenish said barrel when said main valve is on and to cut off said flow of water under pressure when said valve is off, said barrel having drainage valves located at or near said main valve, said drainage valves being pressure operated to open and close when said main valve closes and opens respectively, said barrel having a bonnet at a top thereof, said air valve assembly being mounted between said bonnet and said barrel to connect an interior of said barrel with ambient air when said air valve is open and to cut off said barrel from ambient air when said air valve is closed, said air valve being operable between an open position and a closed position in response to pressure within said barrel, said air valve closing when said main valve is on and opening as pressure within said barrel decreases when said main valve is off.

2. An air valve assembly as claimed in claim 1 wherein said bonnet is located on top of said barrel.

3. An air valve assembly as claimed in claim 2 wherein said air valve assembly is mounted in a wall that extends along said top of said barrel between said bonnet and said barrel.

4. An air valve assembly as claimed in claim 2 wherein said air valve assembly has a piston that moves longitudinally within a bore relative to a seat for said piston.

5. An air valve assembly as claimed in claim 4 wherein said piston and said seat together form an air valve.

6. The air valve assembly as claimed in claim 4 wherein said air valve assembly is in said closed position when said piston is seated against said seat and is in said open position when said piston moves away from said seat.

7. An air assembly as claimed in claim 6 wherein said piston is located beneath said seat and can move by gravity from said closed position to said open position.

8. The air assembly as claimed in claim 1 wherein said assembly has a housing containing at least one opening therein to permit air to flow through said opening when said valve is in said open position.

9. The air valve assembly as claimed in claim 1 wherein said assembly extends through a wall of said barrel to provide a passage between an interior of said barrel and ambient air when said assembly is in said open position.

10. An air valve assembly as claimed in claim 3 wherein said bonnet has an opening therein to allow ambient air to pass between said opening and said air valve assembly.

11. An air valve assembly as claimed in claim 10 wherein said bonnet has a side wall and said opening is a hole in said bonnet through said side wall.

12. An air valve assembly and fire hydrant in combination, said combination comprising a hydrant having a barrel with a main valve operable between an on position and an off position, said main valve being located at a lower end of said barrel and being open to charge said hydrant and to supply water from said hydrant, with drain valves located near said main valve, said drain valves being pressure operated to close when said main valve is on and to open when said main valve is closed respectively, said barrel having a bonnet at a top thereof, said air valve assembly being mounted between said bonnet and said barrel to connect an interior of said barrel with ambient air when said valve is open, said air valve assembly having access to ambient air, said air valve assembly having an open position and a closed position, said air valve assembly being constructed to close under pressure when said hydrant is charged with water and said hydrant is on and being constructed to open under pressure when said hydrant is turned off, said air valve assembly permitting air to enter said barrel to cause said barrel to drain properly.

13. A method of constructing a fire hydrant having a barrel with a main valve, said main valve being connected to a water supply, said main valve having an on position and an off position, there being drain valves around a base of said barrel that open under pressure when said main valve is turned off, said drain valves being closed off when said main valve is on, said barrel having a bonnet at a top thereof, said method comprising installing an air valve assembly in said barrel to connect an interior of said barrel with ambient air between said barrel and said bonnet, constructing said air valve assembly to close under pressure when said main valve is turned on and to open to allow ambient air to enter said interior of said barrel when said main valve is turned off, said ambient air causing the water within said barrel to substantially drain from said drain valve when said main valve is off.

14. An air valve assembly for a fire hydrant, said hydrant having a bonnet at a top thereof, said air valve assembly comprising a pressure responsive valve mounted in a housing at a top of said hydrant between said bonnet and an interior of said hydrant, said assembly having a closed position and an open position, in an open position said assembly providing a passage between ambient air and said interior of said hydrant, said hydrant having a main valve and a drain valve, said assembly being constructed to move to said closed position when said hydrant is on and to move to said open position when said hydrant is off.

* * * * *